US009326571B2

(12) United States Patent
Nevatia et al.

(10) Patent No.: US 9,326,571 B2
(45) Date of Patent: May 3, 2016

(54) JEWELRY WITH CHANGEABLE AND ADDABLE MOBILE DECORATIVE ELEMENTS

(71) Applicant: M/s. SUNJEWELS International Pvt. Ltd., Mumbai (IN)

(72) Inventors: Shishir B Nevatia, Mumbai (IN); Ron Rosen, New York, NY (US)

( * ) Notice: Subject to any disclaimer, the term of this patent is extended or adjusted under 35 U.S.C. 154(b) by 199 days.

(21) Appl. No.: 14/270,361

(22) Filed: May 6, 2014

(65) Prior Publication Data

US 2015/0257497 A1 Sep. 17, 2015

(30) Foreign Application Priority Data

Mar. 12, 2014 (IN) ..... 835/MUM/2014

(51) Int. Cl.
*A44C 17/02* (2006.01)

(52) U.S. Cl.
CPC ..... *A44C 17/0208* (2013.01)

(58) Field of Classification Search
None
See application file for complete search history.

(56) References Cited

U.S. PATENT DOCUMENTS 5,983,669 A * 11/1999 Karmeli ..... A44C 7/006 24/511

FOREIGN PATENT DOCUMENTS

DE 9200711 U1 * 4/1992 ..... A44C 17/025

* cited by examiner

*Primary Examiner* — Jack W Lavinder

(57) ABSTRACT

The present invention relates to a jewelry (100) having decorative elements (90) in the jewelry (100) that are mobile and can be changed allowing the personalization of the jewelry (100). The plurality of decorative elements (90) is mounted and un-mounted into/from the main frame (10) through the lock system (40) provided at the main frame (10). The main frame (10) forms a track for the elements to oscillate freely. The lock system (40) allows the decorative elements (90) to be secured into the main frame (10). A secondary frame (20) provides firmness to jewelry (100). A flip-over safety lock (70) is provided to further secure the decorative elements (90) and at the same time to hide the mechanical arrangements.

11 Claims, 18 Drawing Sheets

JEWELRY WITH CHANGEABLE AND ADDABLE MOBILE DECORATIVE ELEMENTS

FIELD OF INVENTIONS

The present invention relates to a jewelry and particularly to jewelry with mobile and changeable decorative elements to change the look of the jewelry.

BACKGROUND OF THE INVENTION

Wearing jewelry to enhance appearance of various parts of the body is a concept that predates recorded history. Jewelry designs generally include some kind of gemstone or decorative construction attached in a mounting. Large variety of jewelry is typically fashioned in such a way that they form a single static unit, such that it provides the jewelry wearer with one look for every item purchased.

Jewelry with different and fresh looks and appeal is often the wish of the wearer of jewelry. The desired variety can be achieved by owning a number of jewelry items, for example, several different rings, and periodically changing the ring being worn. The disadvantage of this approach is that the user is obligated to invest in a series of jewelry items which, for the most part, lie idly in the jewelry box and are only occasionally worn.

An alternative approach is to vary the appearance of a jewelry item by detachably connecting to the jewelry item an ornamental member which alters the appearance of the overall item.

The replaceability of decorative or ornamental elements in jewelry articles such as rings, pendants, earrings, necklaces, bracelets and broaches is already known where precious stone or ornamental member can be fitted through some links or magnetic mechanism, such that the wearer can detach and re-fit different ornamental elements.

A number of concepts for attaching a decorative or ornamental element to jewelry are available. In most instances, such arrangements deploy means where the ornamental element is attached and detached in apparent and direct manner whereby it is highly probable that the appearance gets impaired or whereby the detachment can happen inadvertently.

U.S. Pat. No. 7,823,415 of Caroline, discloses a piece of jewelry with mobile elements. The piece of jewelry is toroidal in shape having an annular, enclosed space closed upon itself of which the outer wall and/or inner wall are at least partly transparent. The enclosed space holds the decorative elements freely moving inside of it. The lower ring has holes, while the upper ring has threaded holes. The holes of the lower ring are aligned with threads of the upper ring, while each of the channels of studs are aligned with a hole and threaded hole. Screw hold the two rings and toward the edges of the outer wall and inner wall. While the design disclosed in U.S. Pat. No. 7,823,415 has some element of dynamism in looks due to mobility, it does not offer variety in appearance as such.

EP patent no 1314372 to Philip, discloses a bracelet having a strap with one or more jewels moving in the piece of jewelry. A portion of the bracelet is divided longitudinally into two parts, wherein the guide is formed by the guide slots, which are arranged in mutually facing surfaces of the part and the support part guide members are arranged, which project into the guide slots. The strap comprises means for changing jewels. While the disclosure does offer variation in appearance, the arrangement of opening, changing and assembling is fairly extensive and needing care and skill, which is not "jewelry-like" and discouraging to wearers.

EP patent no 0613344 to Albrecht, discloses a piece of jewelry having an annularly closed bracelet with two or more ring-shaped frame longitudinal members which are in the direction of the axis of the ring axially disposed adjacent one another and at an axial distance from one another. The longitudinal frames are connected to each other with traverse webs. The decorative elements provided glide over the longitudinal frame. However, the piece of jewelry disclosed does not allow the personalization of the jewelry to match the attire of the user as it has no provision for changing the decorative elements.

U.S. Pat. No. 4,305,262 to Carl discloses an item of jewelry which includes an elongated mounting base in the form of a straight, curved or angled bar, or the like, of polygonal cross-sectional configuration having one or a plurality of gems longitudinally slidably mounted thereon with each gem including a gem mount having a hollow passageway interfitting with the bar to provide sliding movement. The patent discloses that assembly and dis-assembly of the mount needs use of a pliers or an equivalent tool, and this implies that the changeability is not intended to be achievable by the wearer. Also, opening and closing the mount few time shall cause permanent deformation and shall eventually cause mechanical fracture at the edge of the split sleeve of the mount U.S. Pat. No. 5,896,757 to Joseph discloses an article of jewelry with a moveable mounting. The tracks are placed parallel for receiving a sliding gem mounting which move within the tracks of the bracelet. The track and gem both have construction that allows the mobility of the gem. The article of jewelry in this prior art allows mobility of the gems but the construction is complex. The user has to make sure that the construction of the gem fits exactly with the internal construction of tracks. The article of jewelry does not allow the user option of addability and changeability of the elements according to one's wish for matching the attire and the occasion.

U.S. Pat. Nos. 4,488,415 and 5,165,257 disclose jewelry with modularity and changeability however there is no dynamism or mobility feature.

International application, Publication Number WO2014/032075A1 discloses a jewelry assembly with sliding pendants, having two/three chain rails on which separate interchangeable link charms are slid and held in place. The charms have open tubular loops. The key construction of the clasp is passed through the opening of the tubular loops to be able to assemble the charms on the rails. The construction apparently has mobility; however changeability is with high skill, therefore not meant for the wearer. The opening of the tubular loops is towards the body of the wearer and is likely to cause bruises, when charms move or even when stationery.

It is understood from the foregoing that achieving elegant mobility and easy changeability in a jewelry remains a challenge.

To achieve changeability feature, in particular by wearer, there needs to some non permanent and mechanical arrangement, which is intuitive and simple, allowing the user to himself change the overall appearance of the jewelry. Changeability arrangement, however, is either complex or mars the aesthetics and appearance of the jewelry and results in compromise on basic aspect of the jewelry. Also, such jewelry has less perceived "value".

Our invention addresses and solves these problems.

Objective of the Invention

The objective of the invention is to derive variety of looks from jewelry by adding a decorative element in the jewelry.

Another objective of the invention is to derive variety of looks from jewelry by adding multiple decorative elements in the jewelry.

Another objective of the invention is to provide elegant mobility to the elements in jewelry.

Another objective of the invention is to conceal the construction and arrangement of replacement and addition of decorative elements.

Another objective of the invention is to provide to the wearer an easy arrangement of changeability and addability of the decorative element.

Another objective of the invention is to ensure abundant security of the replaceable elements against inadvertent falling off.

Yet another object of the invention is to provide an economical piece of jewelry by less use of precious metal.

Statement of Invention

The present invention discloses jewelry wherein one or more decorative elements can be added and or changed, by the wearer, and the decorative elements in the jewelry are mobile. The mechanical arrangement to replace the decorative elements is secure, such that the decorative element cannot dislodge inadvertently and at the same time the mechanical arrangement is self concealing.

The jewelry has a frame, comprising of a main frame and a secondary frame that are connected to each other by a plurality of connectors placed perpendicular to the main frame and the secondary frame. These connectors are placed onto a rear side of the main frame, so that they do not impair the aesthetics of the jewelry.

The main frame has an elongated portion, a curved portion and a lock system, forming a closed loop structure. The main frame and the secondary frame form a track onto which plurality of decorative elements is mounted and allowing the plurality of decorative element to oscillate freely in the frame. The main frame exhibits the decorative element while the secondary frame provides additional firmness and richness to the jewelry. The jewelry while having larger outlook and volume coverage has large empty space and is therefore perceivably economical with respect to jewelry of comparable overall size.

The lock system is a part of the main frame. The lock system has an arm having a curved shape, where a first end of the arm is attached to the elongated portion of the main frame through a pivot joint while a second end of the arm has a groove region. The groove region is optionally provided with a depression zone, termed groove. The groove accommodates a projection zone, termed ledge, which is optionally present on the ledge region on the other elongated portion of the main frame. Groove regions and ledge regions are individually each slightly less than half sections of the profile of the main frame, such that, the profile looks joint-less, once ledge region and groove region overlap in closed configuration.

An open configuration is obtained by turning the arm of the lock system away along the pivot joint so as to undo the overlap between the grove region and the ledge region, thus separating the connection formed earlier between the ledge and the groove. The turning away movement of the arm is obtained due to the pivot joint. The open configuration allows the user to insert or remove the plurality of elements into/from the main frame.

A closed configuration is obtained by turning the arm so as to overlap the ledge region and groove region along the pivot joint allowing the connection between the ledge and the groove. The closed configuration traps the inserted element in the main frame.

A leaf spring is placed internally in the arm of the lock system allowing the arm to move from the closed configuration to the open configuration and vice versa. The leaf spring toggles the arm between the open configuration and closed configuration.

A flip-over lock is present near the lock system and attached to the secondary frame at the rear side of the main frame through a hinge joint. The lock system cannot open once secured with the flip-over safety lock thus further protecting the decorative elements in the main frame. The flip-over safety lock hides joints and overlapping regions thus improving aesthetical value The plurality of decorative elements has a compatible channel configuration such that the elements can be easily mounted and un-mounted from the main frame. The main frame has a round cross-section compatible with corresponding channel configuration of the decorative element, such that the decorative element can be easily inserted, removed and is free to oscillate.

DETAILED DESCRIPTION OF INVENTION

Preferred embodiment of our invention of a jewelry (100), changeable and addable with a plurality of decorative element (90) will now be described in detail, with reference to the accompanying drawings. The terms and expressions which have been used here are merely for description and not for limitation.

Figure 15:
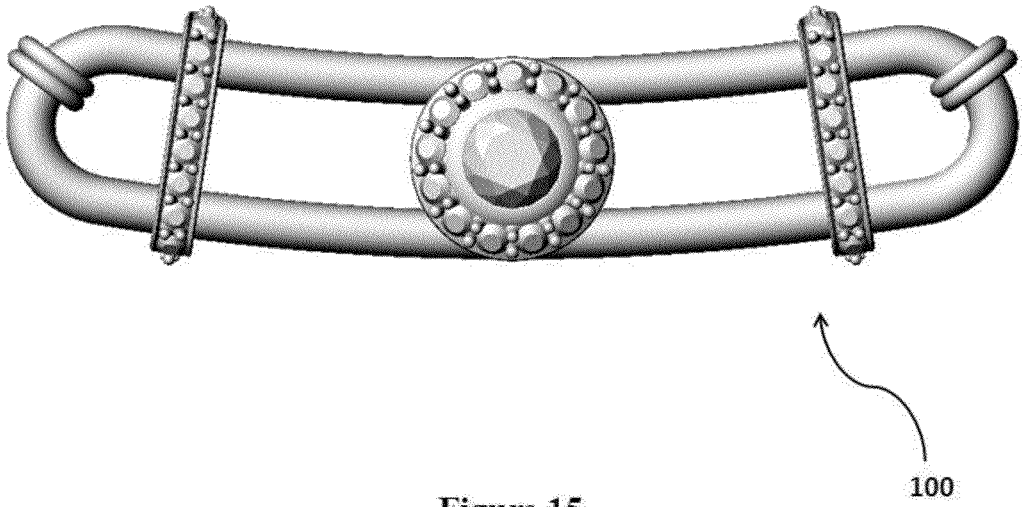
FIG. 15 illustrates jewelry as it appears with decorative element, a flip-over safety lock and a dummy.

FIG. 15 shows an embodiment of the complete jewelry (100) as it appears. The inventive jewelry (100) has a frame (200) and a decorative element (90), which can be changed and added and is mobile, as shown in FIG. 1.

Figure 1:
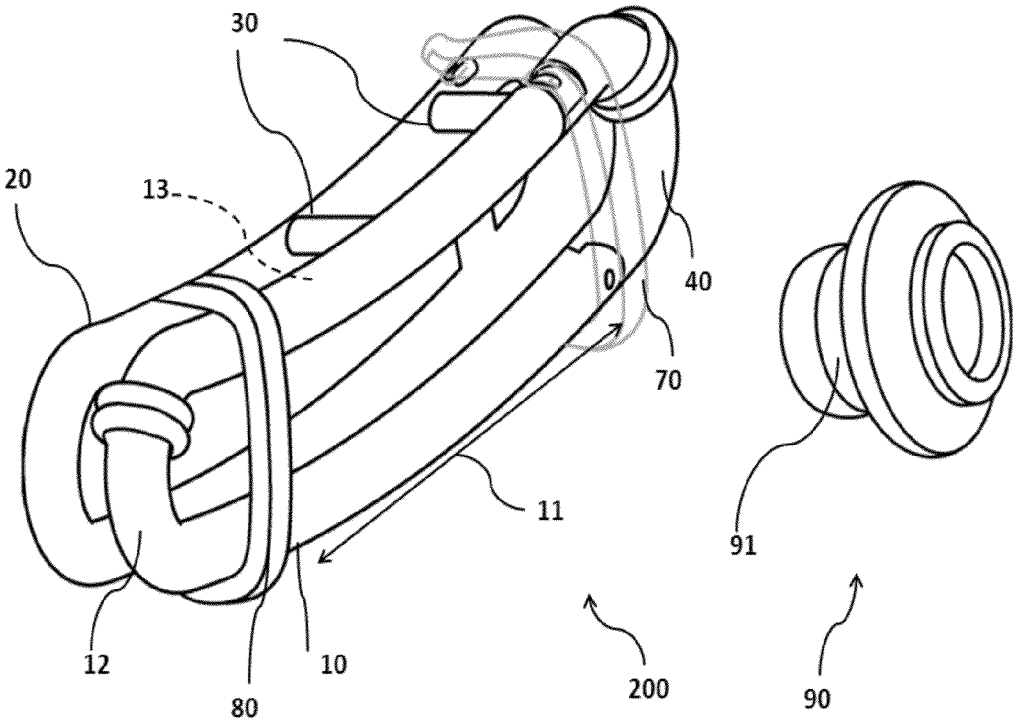
FIG. 1 illustrates a frame of jewelry that is a main frame and a secondary frame connected through connector, and a decorative element.
Figure 2:
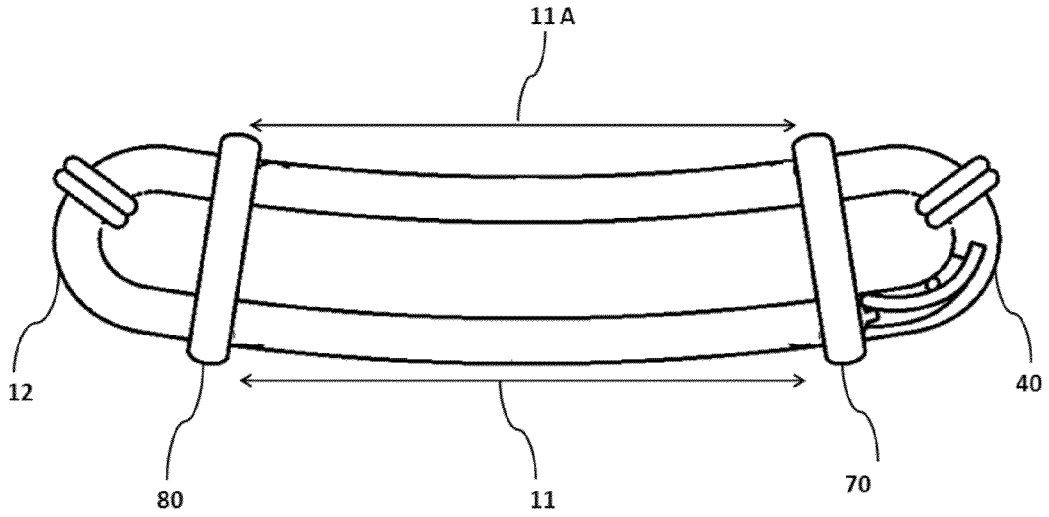
FIG. 2 illustrates the front view of main frame.

In the preferred embodiment according to the FIGS. 1 & 2, the frame (200) has a main frame (10) and a secondary frame (20). The main frame (10) has an elongated portion (11) and (11A), a curved portion (12) and a lock system (40), forming a closed loop structure. The main frame (10) and the secondary frame (20) form a track onto which the plurality of decorative elements (90) is mounted and the decorative element (90) oscillates freely in the frame (100). The main frame (10) exhibits the decorative element (90) while the secondary frame (20) provides firmness to the jewelry (100). Further, the secondary frame (20) has provision for anchoring hinge point (71) and provision for locking flip-over safety lock (70), as shall be described subsequently.

Referring to FIG. 1, the frame (200) has a main frame (10) and a plurality of secondary frame (20) that are connected to each other by a plurality of connectors (30) placed perpendicular to the main frame (10) and secondary frame (20). These connectors (30) are placed onto a rear side (13) of the main frame (10) so as not to be visible from front. This arrangement in the jewelry (100) makes it sturdy without impairing appearance. The jewelry (100) while having larger outlook and volume coverage has large empty space and is therefore perceivably economical with respect to jewelry of comparable overall size.

The main frame (10) and secondary frame (20), as shown in FIG. 1, are made of a metal that has ornamental and aesthetic value and at the same time is tenacious enough so as to retain the shape provided, such that the mobile decorative element (90) can be inserted as well can be removed and also the decorative element (90) has freedom to oscillate.

Figure 3A:
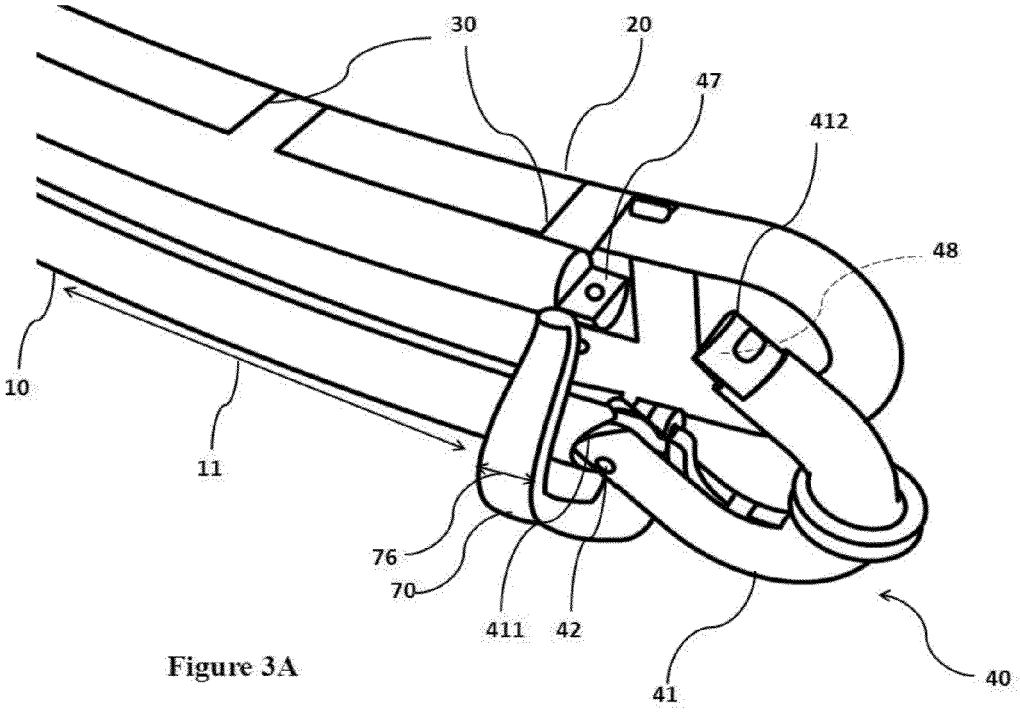
FIG. 3A illustrates a lock system of the jewelry with arm, ledge region, groove region, pivot joint; along with flip-over safety lock and hinge joint.

As illustrated in FIG. 3A, the lock system (40) is a part of the main frame (10). The lock system (40) has an arm (41) having a curved shape where a first end (411) of the arm (41) is attached to the elongated portion (11) of the main frame (10) through a pivot joint (42) while a second end (412) of the arm (41) has a groove region (48). The first end (411) of the arm (41) is a partially hollow. The groove region (48) is optionally provided with a depression zone, termed groove (44). The groove (44) accommodates a projection zone, termed ledge (43), which is optionally present on the ledge region (47) on the elongated portion (11A). Groove regions (48) and ledge regions (47) are individually each slightly less than half sections of the profile of the main frame (10), such that, the profile looks joint-less, once ledge region (47) and groove region (48) overlap.

Figure 4A:
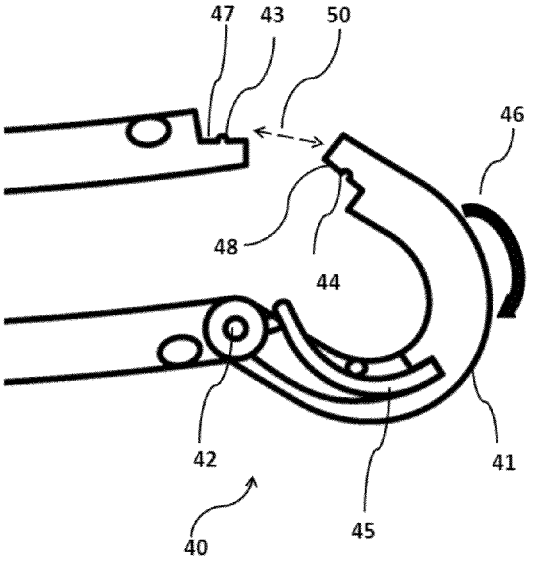
FIG. 4A and FIG. 4B illustrate the lock system in open configuration and close configuration respectively.

Referring to FIG. 4A, an open configuration (50) of the lock system (40) is obtained by turning away (46) the arm (41) of the lock system (40) along the pivot joint (42), so as to undo the overlap between the ledge region (47) and the groove region (48) and thus separating the connection formed earlier between the ledge (43) and the groove (44). The open configuration (50) allows the user to insert or remove the plurality of decorative elements (90) into/from the main frame (10).

Figure 4B:
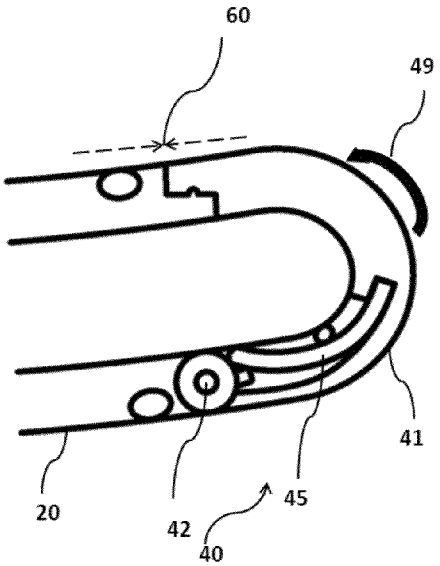

Referring to FIG. 4B, a closed configuration (60) of the lock system (40) is obtained by releasing (49) the arm (41), along the pivot joint (42); thereby the groove region (48) and the ledge region (47) overlap, allowing the connection between the ledge (43) and the groove (44). The closed configuration traps the decorative element (90) in the main frame (10).

Figure 5:
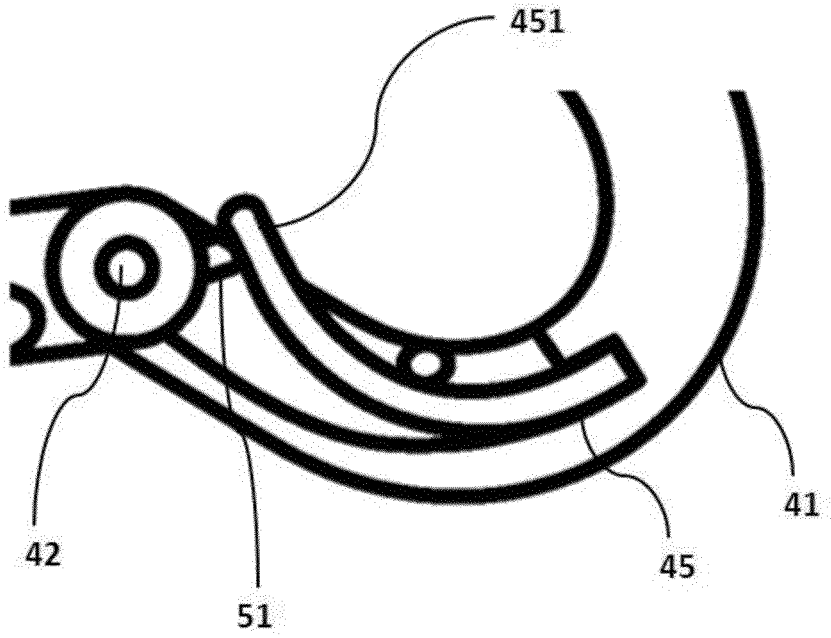
FIG. 5 illustrates a leaf spring and pip construction.

As shown in FIG. 5, the arm (41) of the lock system (40) is provided with a leaf spring (45), concealed in the partially hollow portion of the first end (411) of the arm (41). Function of leaf spring (45) is to stayput the arm (41) either in the open configuration (50) or in the close configuration (60), when the leaf spring negotiates with pip (51) provided on the elongated portion (11) of the main frame (10), when the arm (41) is being rotated around the pivot joint (42).

The arm (41) has a tendency to stayput either in close configuration (60) or in open configuration (50) depending on position of fulcrum end (451) of leaf spring (45) on pip (51).

Figure 6A:
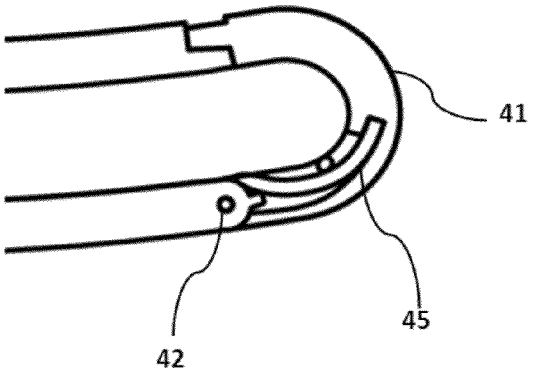
FIG. 6A, 6B, 6C, 6D show arm of the lock system in various positions and toggling.
Figure 6B:
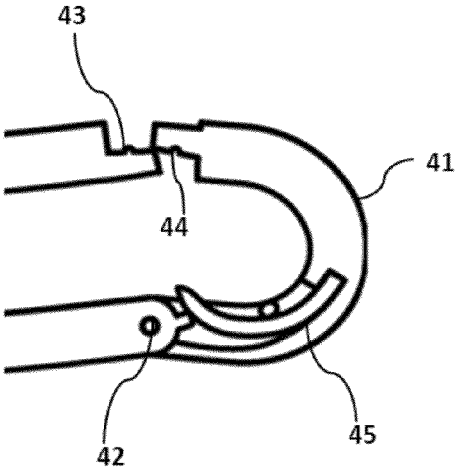
Figure 6C:
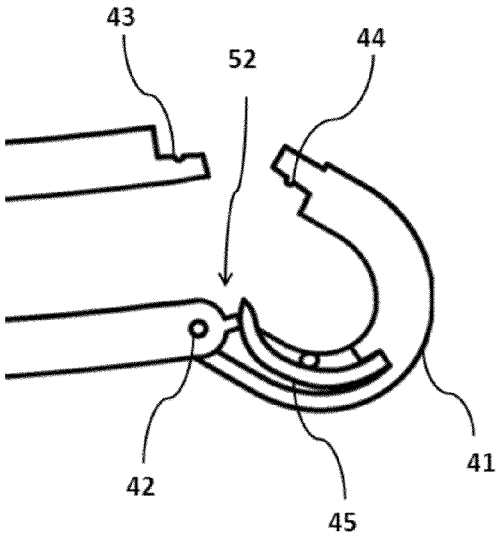
Figure 6D:
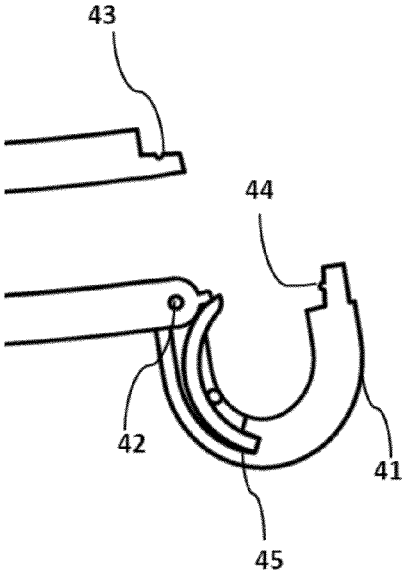

Referring to FIGS. 6A, 6B, 6C and 6D; consequent to movement of the arm (41), when the fulcrum end (451) of the leaf spring (41) is resting ON the pip (51) as shown in FIG. 6C, the arm (41) has no bias, that is, the arm (41) either rushes to fully open configuration (50) as shown in FIG. 6D, or the arm (41) rushes to fully close configuration (60) as shown in FIG. 6A, depending upon the direction of little force applied on the arm (41). This exact situation as depicted in FIG. 6C is the toggle point (52) and this behaviour of the arm (41) is known as toggling. The arm (41) has the tendency to stayput either in close configuration (60) or in open configuration (50), since the leaf spring (45) cannot generally stabilize at toggle point (52).

Since the toggle point (52) is significantly away from the close configuration (60), leaf spring (45) primarily secures the decorative element (90) against inadvertent disengagement of ledge region (47) and groove region (48).

Figure 7:
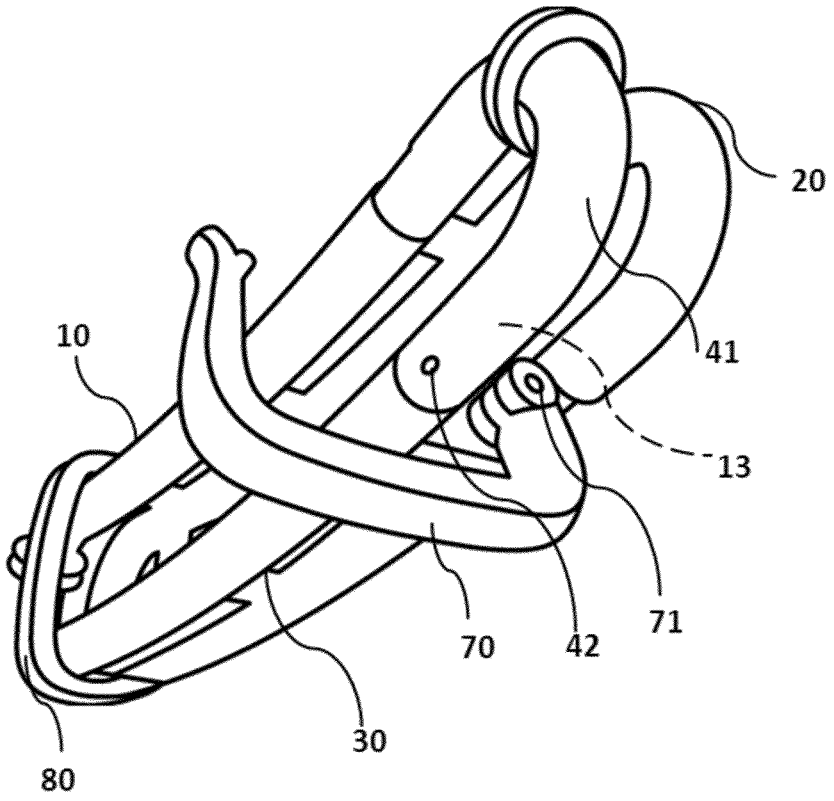
FIG. 7 illustrates the flip-over safety lock of the jewelry and the hinge joint anchored on the secondary frame.
Figure 8A:
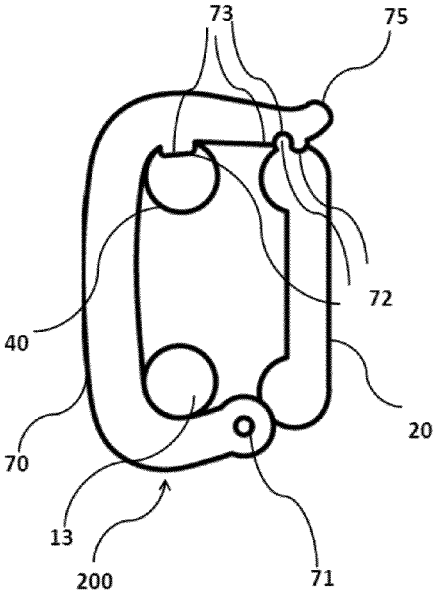
FIG. 8A, 8B illustrate the closed and the open flip-over safety lock with depressions and projections correspondingly engaged and disengaged correspondingly.
Figure 8B:
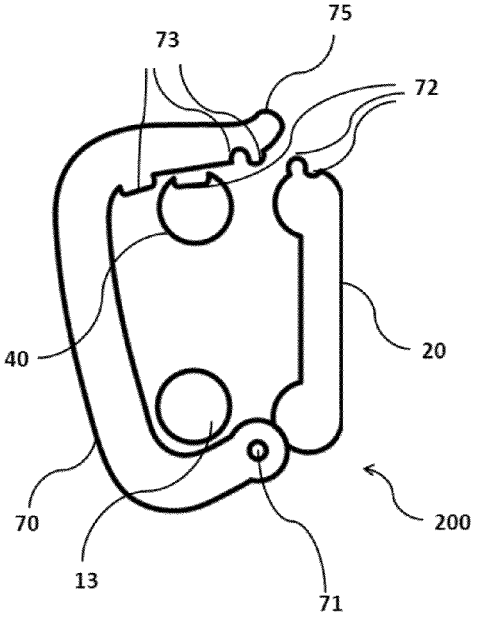

According to FIG. 7 and FIGS. 8A & 8B, the jewelry (100) further has a flip-over safety lock (70). Flip-over safety lock (70) is anchored to the secondary frame (20) through a hinge joint (71) such that the hinge joint (71) is at rear side (13) of the main frame (10). The flip-over safety lock (70) further secures the lock system (40). The flip-over safety lock (70) can freely rotate consequent to hinge point (71), in a plane transversal to plane of rotation of the arm (41).

As shown in FIGS. 8A and 8B, a combination of projections and depressions (73) are provided on the inner side of the flip-over safety lock (70) and correspondingly opposite depressions and projections (72) are provided on the arm (41) and secondary frame (20), such that the lock system (40), once in close configuration (60), cannot attain the open configuration (50) when the combinations of projections and depressions (72 and 73) are mutually engaged as represented in FIG. 8A. Said engagement is achieved by the wearer pushing up and pressing the flip-over safety lock (70) gently. The engagement of depression and projection on the arm (41) and the secondary frame (20), actually provide two independent locking. Consequently, the flip-over safety lock (70) provides two locks in securing the decorative elements (90) in the main frame (10).

To bring the arm (41) in open configuration (50), whether to remove and replace or to add the decorative elements (90), mutual disengagement as represented in FIG. 8B is achieved by the wearer gently lifting the bulge (75) and then hinging away the flip-over safety lock (70). Such mutual engagement and disengagement needs minimal flexing of the flip-over safety lock (70) and which is achievable consequent to properties of selected metal, the construction of the flip-over safety lock (70) and the construction of the projections and depressions (72 and 73).

Importantly, the width (76) of the flip-over safety lock (70) is dimensioned such as to completely hide the groove region (48), the ledge region (47), the pivot joint (42), behind the width (76) of the flip-over safety lock (70) when the lock system is in close configuration (60) and projections and depressions (72, 73) are mutually engaged, and that is, when the jewelry (100) is ready to wear. Further, hinge joint (71) as well as projections and depressions (72, 73) have virtually NIL or minimal visibility from front, that is, as the jewelry appears, as in FIG. 15. Consequently, once the jewelry (100) is ready to wear, the mechanical arrangements described are concealed and do not impair the intrinsic appearance of the jewelry (100). FIG. 1, FIG. 3A and FIG. 8B illustrate this aspect.

Further, a construction termed as dummy (80), as shown in FIGS. 1 and 2, similar in frontal appearance to the flip-over safety lock (70) is optionally provided near the curved portion (12) at the other end of the elongated portion (11) of the main frame (10) at an aesthetically pleasant location, specifically with respect to the flip-over safety lock (70). This construction of dummy (80) increases the overall beauty of the jewelry (100), while camouflaging and therefore further concealing the mechanical arrangements.

The decorative element (90) is made of precious metal, hollow or solid, with or without precious stones, pearls, etc. The size of the decorative elements (90) may vary depending upon the shape, size and the function of the jewelry (100).

Figure 9:
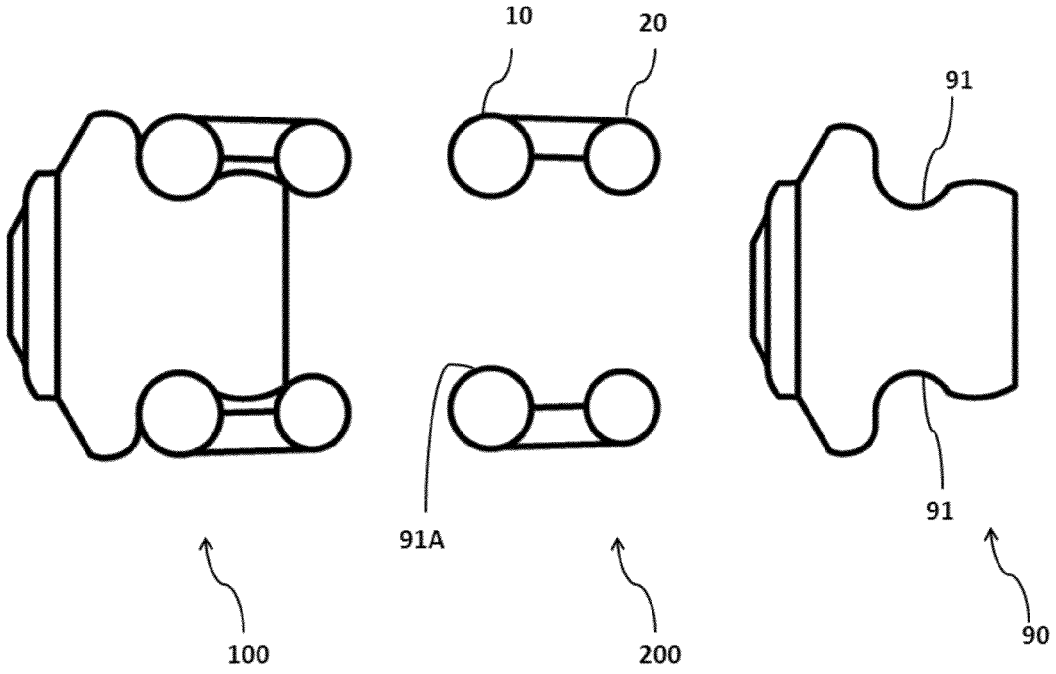
FIG. 9 illustrates the decorative element in the frame, also the decorative element and the frame separately, to show the compatibility of the channel configuration of the decorative element with profile of the frame.

In a preferred embodiment, according to FIG. 9, the plurality of elements (90) has a channel configuration (91), compatible with the profile (91A) of the main frame (10) such that the decorative elements (90) can be easily mounted and unmounted from the main frame (10). The main frame (10) can be a round profile (91A) or substantially round cross-section compatible with corresponding channel configuration (91) of the decorative element (90), such that the decorative element (90) can be easily inserted, removed and is free to oscillate on the main frame (10).

Figure 10:
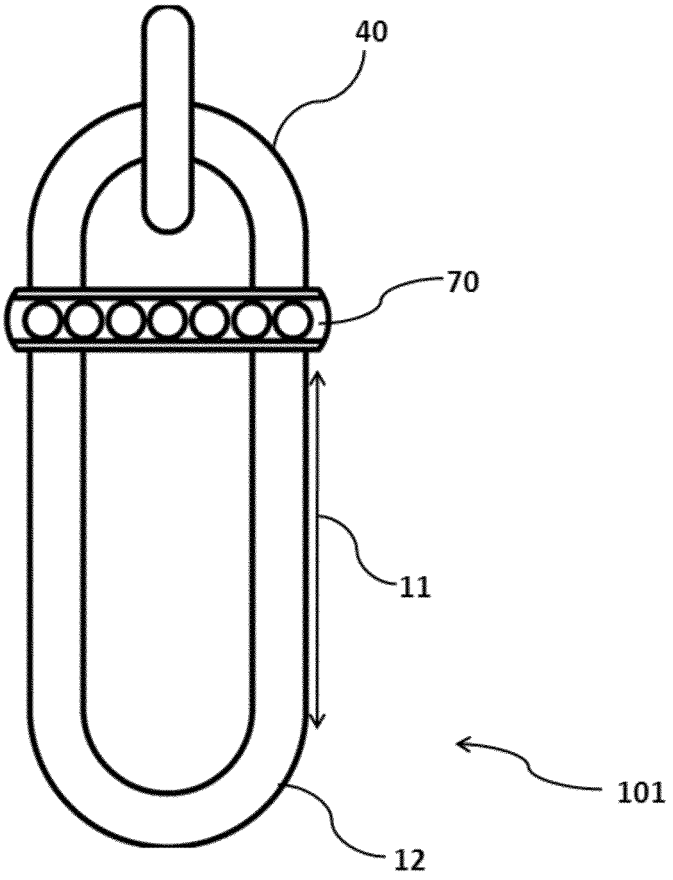
FIG. 10 illustrates the embodiment of vertical frame of the jewelry

According to FIG. 10, the main frame (10) can be also worn vertically, thus giving a different look to the jewelry (101). The size may vary depending on the type of jewelry, that is whether a pendant or a brooch or an earring or a bracelet, etc.

Figure 11A:
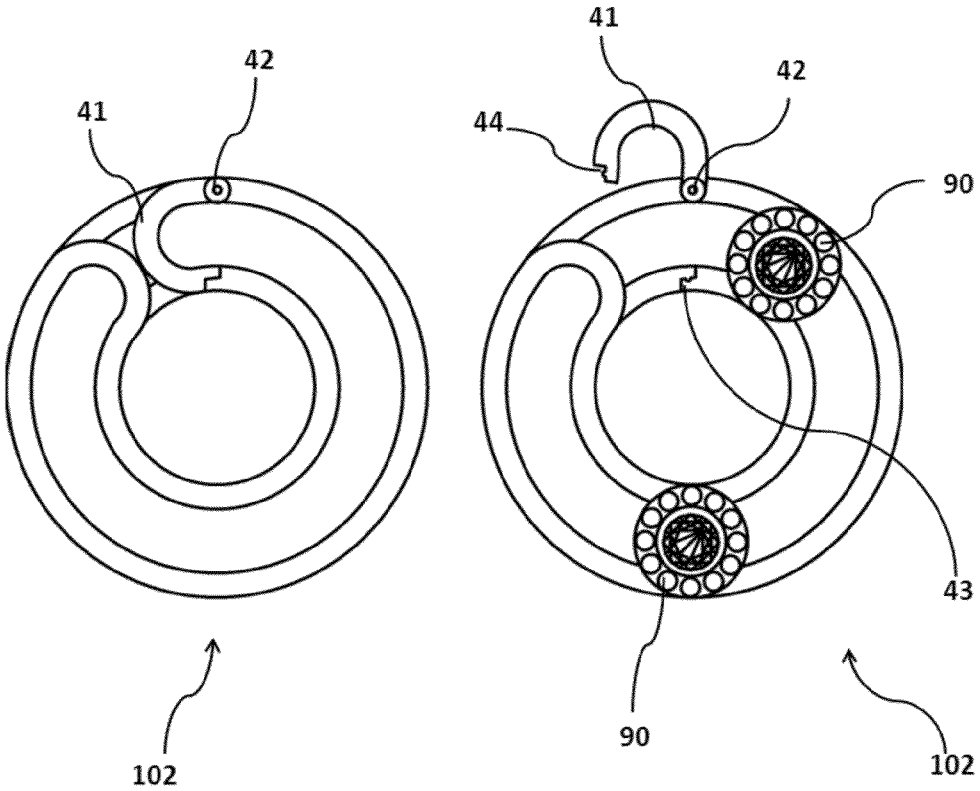
FIG. 11A, 11B illustrate the embodiments of closed loop structure namely circular, and non-circular closed loops.
Figure 11B:
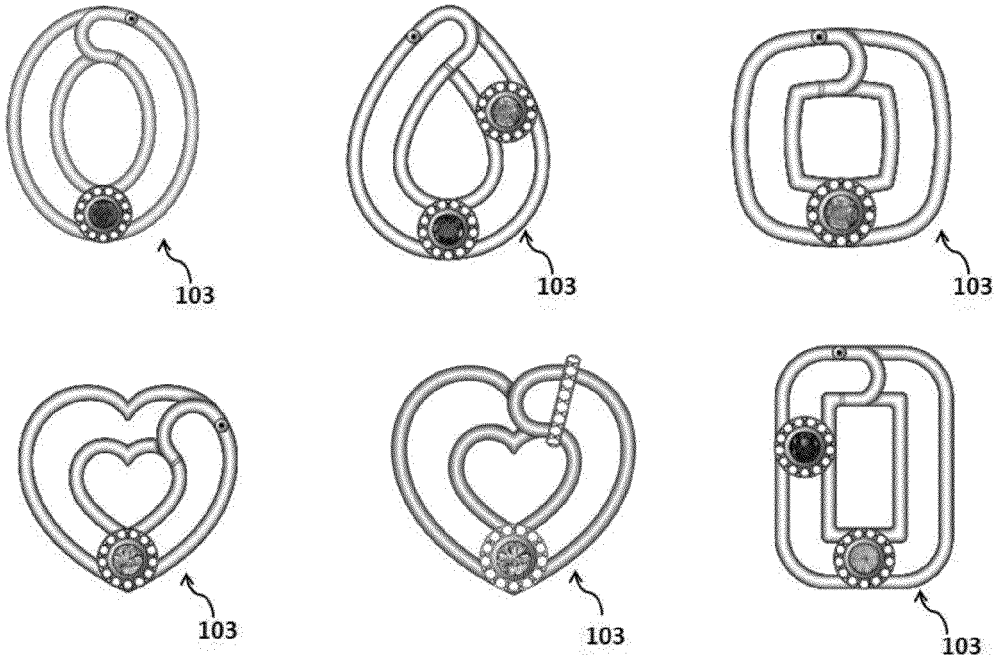

The jewelry, while forming a closed loop structure can have a circular closed loop (102), or a non-circular closed loop (103), or a partially circular closed loop or a partially non-circular closed loop, including but not limited to a heart shape, square or rectangle shape and the shape used for description here does not limit the invention in any way. FIGS. 11A and 11B illustratively depict some of the many possible shapes of the closed loop deployable around this invention.

Figure 12:
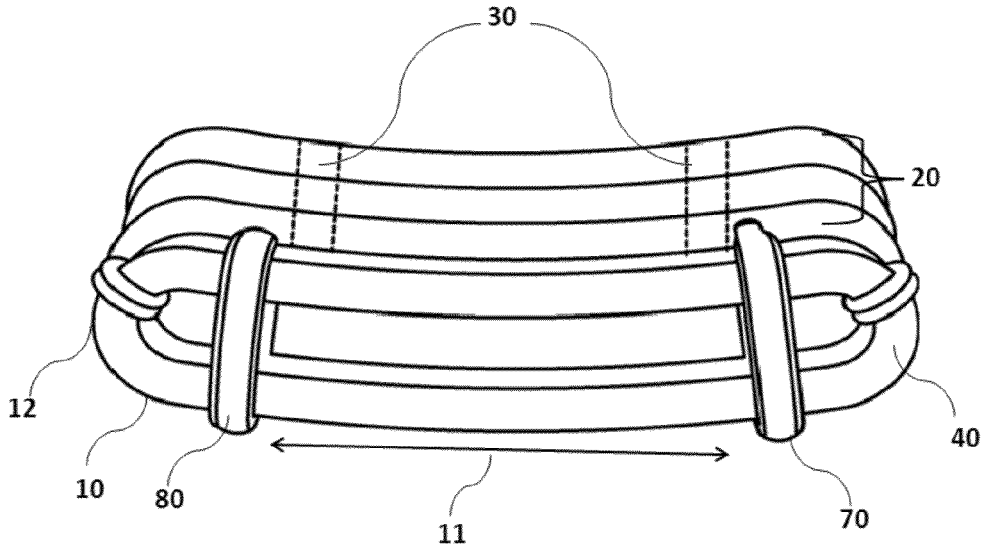
FIG. 12 illustrates more than one secondary frames

In another embodiment, referring to FIG. 12, the firmness of the jewelry can be increased by adding a number of secondary frames (20) connected to each other through a plurality of connector's (30) perpendicular to the frame (10 & 20).

The leaf spring (45) can either be provided internally in the arm (41) or in the rear of the arm (41) in a concealed manner. In another embodiment, the leaf spring (45) may be absent. Consequently, arm (41) does not toggle and can be brought in close configuration (60) and open configuration (50) manually.

As a variation, the ledge (43) can be present on the arm (41) of the lock system (40) while the groove (44) is on the elongated portion (11A) opposite to the pivot joint (42) of the arm (41).

Figure 13:
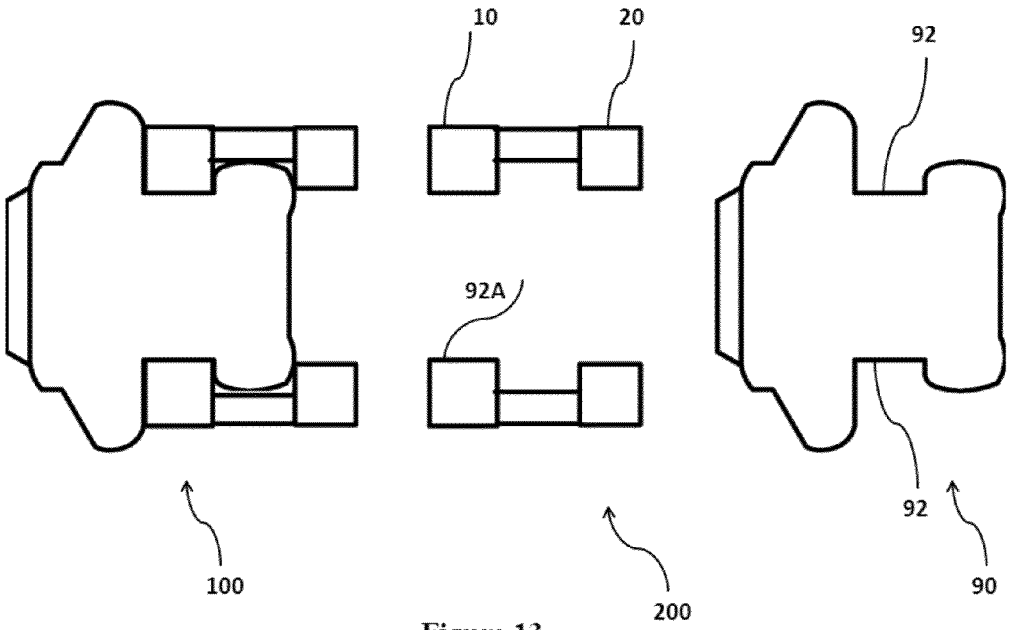
FIG. 13 illustrates another embodiment of the decorative element in the frame, also the decorative element and the frame separately, to show compatibility of the channel configuration of the decorative element with non-round cross-section of the frame.

In another embodiment, as shown in FIG. 13, the main frame (10) can be have a non-round cross-section (92A), compatible with corresponding channel configuration (92) of the decorative element (90), such that the decorative element (90) can be easily inserted, removed and is free to oscillate on the main frame (10).

Figure 14:
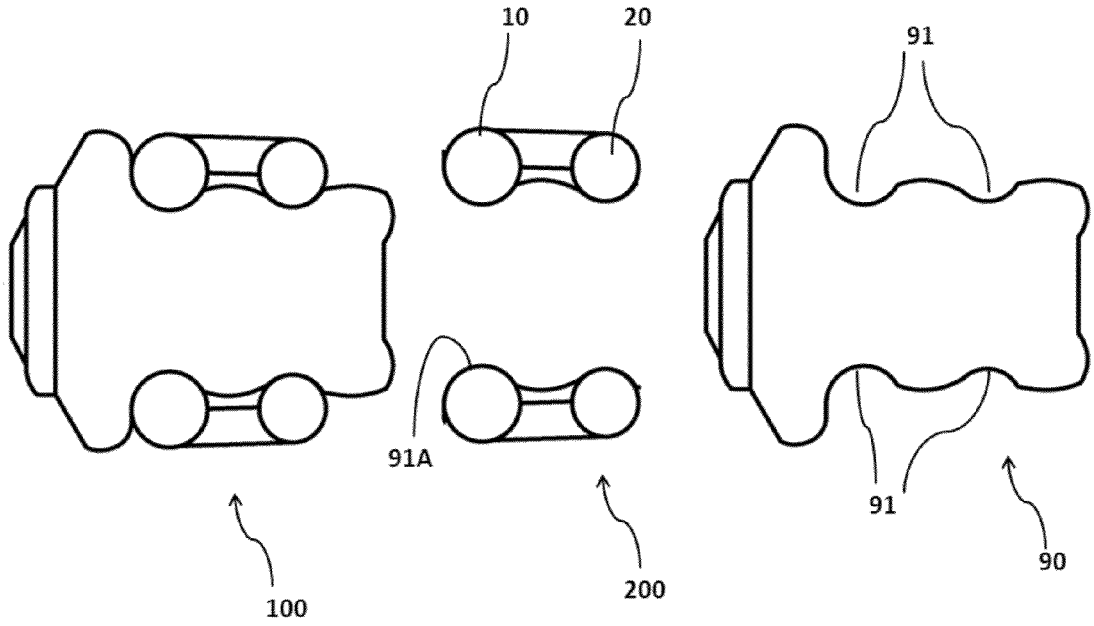
FIG. 14 illustrates another embodiment of the decorative element in the frame, also the decorative element and the frame separately, to show the decorative element projecting from behind the secondary frame.

In another embodiment, as shown in FIG. 14, the decorative element has two compatible channel configurations (91), thus the decorative element (90) is engaged with the main frame (10) and secondary frame (20) such that the decorative element (90) touches the skin of the wearer.

In another embodiment as shown in FIG. 9 & FIG. 13, the main frame (10) can be have cross-section with such compatibility with corresponding channel configuration (91) of the decorative element (90), such that the decorative element (90) can be easily inserted, removed but is NOT free to oscillate on the main frame (10).

Figure 3B:
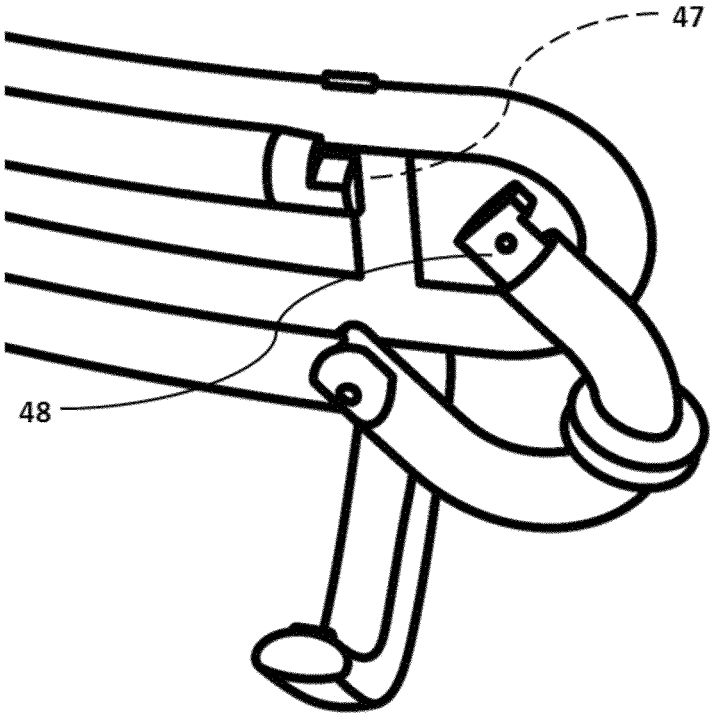
FIG. 3B particularly illustrates groove region and ledge region in different planes than shown in FIG. 3A.

The groove region (48) and the ledge region (47) can also be in same plane as shown in FIG. 3B, instead of in mutually radial planes as shown in FIG. 3A. Also, the groove regions (48) and ledge regions (47) can be in a combination of planes.

The connectors can also be placed angularly and in multiple ways by which they either are concealed from primary appearance or add aesthetical value.

The jewelry can also be without flip-over lock (70).

Thus, it is clear that a large number of embodiments are possible around this invention of a jewelry with flip-over safety lock and or leaf spring redundantly locking the opening and closing arrangement so as to secure the mobile decorative elements, while concealing the mechanical arrangement; and therefore preferred embodiment disclosed above and few embodiments and variation mentioned should not be misconstrued to limit the invention.

We claim:

1. A jewelry (100) changeable and addable with a plurality of mobile decorative elements (90), comprising:

a) a frame (200) comprising of a main frame (10) connected to a plurality of secondary frames (20) through a plurality of connectors (30) forming a track for the plurality of decorative elements (90) and having a closed loop structure;

b) a lock system (40) having an arm (41) secured to an elongated portion (11) of the main frame (10) through a pivot joint (42), the elongated portion (11, 11A), a curved portion (12), a ledge region (47) and a groove region (48) forming said main frame (10);

c) an open configuration (50) allowing mounting and unmounting of the plurality of decorative elements (90) onto/from the jewelry (100) and a close configuration (60) allowing the trapping of the plurality of decorative elements (90) into the frame (200) attained by said lock system;

d) a flip-over safety lock (70) with a hinge joint (71), the flip-over safety lock (70) is present near the lock system (40), anchored to the secondary frame (20) at a rear side (13) of the main frame (20) through the hinge joint (71); and e) a combination of a plurality of projections and a plurality of depressions (72, 73) on an inner side of the flip-over safety lock (70), and the arm (41) of the lock system (40) and the secondary frame (20) having a corresponding opposite plurality of depressions and plurality of projections (72, 73);

the main frame (10) forming a track for the plurality of decorative elements (90) to oscillate freely in the jewelry (100), while the plurality of secondary frames (20) providing firmness to the jewelry (100).

2. The jewelry (100) as claimed in claim 1, wherein said secondary frame (20) has provision for anchoring hinge point (71) and provision for locking of the flip-over safety lock (70).

3. The jewelry (100) as claimed in claim 1, wherein said flip-over safety lock (70) has a width (76) that hides the groove region (48), the ledge region (47), the pivot joint (42) when the lock system (40) is in the close configuration (60) and when the plurality of projections and the plurality of depressions (72, 73) are mutually engaged.

4. The jewelry (100) as claimed in claim 1, wherein said hinge joint (71) as well as said plurality of projections and said plurality of depressions (72, 73) have minimal visibility from front of the jewelry.

5. The jewelry (100) as claimed in claim 1, wherein said lock system (40), once in the close configuration (60), cannot attain the open configuration (50) when the combinations of the plurality of projections and the plurality of depressions (72 and 73) are mutually engaged.

6. The jewelry (100) as claimed in claim 1, wherein a dummy (80) is provided.

7. A jewelry (100) changeable and addable with a plurality of mobile decorative elements (90), comprising:

a) a frame (200) comprising of a main frame (10) connected to a plurality of secondary frames (20) through a plurality of connectors (30) forming a track for the plurality of decorative elements and having a closed loop structure;

b) a lock system (40) having an arm (41) secured to an elongated portion (11) of the main frame (10) through a pivot joint (42), the elongated portion (11,11A), a curved portion (12), a ledge region (47) and a groove region (48) forming said main frame (10); and c) an open configuration (50) allowing mounting and unmounting of the decorative element (90) onto/from the jewelry (100) and a close configuration allowing the trapping of the decorative element (90) into the frame (200) attained by said lock system;

the main frame (10) forming a track for the plurality of decorative elements (90) to oscillate freely in the jewelry (100), while the plurality of secondary frames (20) providing firmness to the jewelry (100).

8. The jewelry (100) as claimed in claim 1 or 7, wherein said lock system (40) present on the main frame (20) attains the open configuration (50) by turning away (46) the arm (41) of the lock system (40) along the pivot joint (42), so as to undo the overlap between the ledge region (47) and the groove region (48) and thus separating the connection between a ledge (43) present on the ledge region (47), and a groove (44) present on the groove region (48).

9. The jewelry (100) as claimed in claim 1 or 7, wherein said lock system (40) present on the main frame (10) attains the close configuration (60) by releasing (49) the arm (41), along the pivot joint (42), thereby groove region (48) and ledge region (47) overlap, allowing the connection between a ledge (43) present on the ledge region (47) and a groove (44) present on the groove region (48).

10. The jewelry (100) as claimed in claim 1 or 7, Wherein said arm (41) has a tendency to stayput either in the close configuration (60) or the open configuration (50), around a toggle point (52) consequent to a leaf spring (45), concealed in a partial hollow portion of a first end (411) of the arm (41), negotiating with a pip (51) provided on the elongated portion (11) of the main frame (10).

11. The jewelry (100) as claimed in claim 1 or 7, wherein said closed loop structure is a circular closed loop (101) or a non-circular closed loop (102) or a partially circular close loop or a partially non-circular closed loop.

* * * * *